US009812071B2

(12) United States Patent
Matsui

(10) Patent No.: US 9,812,071 B2
(45) Date of Patent: Nov. 7, 2017

(54) DISPLAY DEVICE, DISPLAY SYSTEM, VIDEO OUTPUT DEVICE, AND CONTROL METHOD OF DISPLAY DEVICE

(71) Applicant: NEC Display Solutions, Ltd., Tokyo (JP)

(72) Inventor: Katsuyuki Matsui, Tokyo (JP)

(73) Assignee: NEC Display Solutions, Ltd., Tokyo (JP)

( * ) Notice: Subject to any disclaimer, the term of this patent is extended or adjusted under 35 U.S.C. 154(b) by 63 days.

(21) Appl. No.: 14/889,172

(22) PCT Filed: May 22, 2013

(86) PCT No.: PCT/JP2013/064192
§ 371 (c)(1),
(2) Date: Nov. 5, 2015

(87) PCT Pub. No.: WO2014/188533
PCT Pub. Date: Nov. 27, 2014

(65) Prior Publication Data

US 2016/0086551 A1 Mar. 24, 2016

(51) Int. Cl.
*G09G 3/34* (2006.01)

(52) U.S. Cl.
CPC ... *G09G 3/3413* (2013.01); *G09G 2320/0242* (2013.01); *G09G 2320/045* (2013.01);
(Continued)

(58) Field of Classification Search
CPC .. G09G 3/12; G09G 3/14; G09G 3/32–3/3426
See application file for complete search history.

(56) References Cited

U.S. PATENT DOCUMENTS 8,427,419 B2 * 4/2013 Ahn ..... G09G 3/3426 345/102
8,670,006 B2 * 3/2014 Hong ..... G09G 3/3426 345/102
(Continued)

FOREIGN PATENT DOCUMENTS

JP H05-127620 A 5/1993
JP 2007-322718 A 12/2007
(Continued)

OTHER PUBLICATIONS

International Search Report (ISR) (PCT Form PCT/ISA/210), in PCT/JP2013/064192, dated Aug. 27, 2013.

*Primary Examiner* — Patrick F Marinelli
(74) *Attorney, Agent, or Firm* — McGinn IP Law Group, PLLC

(57) ABSTRACT

A display device includes an emission part further including a first light source emitting a first light, a second light source emitting a second light having a longer wavelength than the first light, and a fluorescent substance which is excited by the first light and the second light so as to emit a third light, and a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources.

9 Claims, 9 Drawing Sheets

(52) U.S. Cl.
CPC ..... *G09G 2320/0626* (2013.01); *G09G 2320/0633* (2013.01); *G09G 2320/0666* (2013.01); *G09G 2330/021* (2013.01); *G09G 2360/145* (2013.01); *G09G 2360/16* (2013.01)

(56) References Cited

U.S. PATENT DOCUMENTS

2005/0200295 A1* 9/2005 Lim ..... G09G 3/3413 315/150
2006/0066266 A1* 3/2006 Li Lim ..... G02F 1/133603 315/291
2007/0171217 A1* 7/2007 Tsai ..... G09G 3/3406 345/207
2008/0174605 A1* 7/2008 Kiuchi ..... G09G 3/22 345/531
2010/0156927 A1* 6/2010 Takase ..... G09G 3/3413 345/589
2010/0171690 A1* 7/2010 Park ..... G09G 3/3413 345/102
2010/0244701 A1* 9/2010 Chen ..... G02F 1/133603 315/117
2011/0025731 A1* 2/2011 Hayashi ..... G02B 6/0068 345/690
2012/0182276 A1* 7/2012 Kee ..... G09G 5/10 345/207
2015/0161932 A1* 6/2015 Kure ..... G09G 3/3426 345/690
2015/0268408 A1* 9/2015 Ohta ..... G02F 1/133609 349/65
2016/0086551 A1* 3/2016 Matsui ..... G09G 3/3413 345/690
2016/0111048 A1* 4/2016 Matsui ..... G09G 3/3413 315/151
2016/0117970 A1* 4/2016 Matsui ..... G09G 3/3406 345/690
2016/0180778 A1* 6/2016 Chang ..... H05B 33/0848 345/690

FOREIGN PATENT DOCUMENTS

JP 2010-145773 A 7/2010
JP 2010-197840 A 9/2010

* cited by examiner

DISPLAY DEVICE, DISPLAY SYSTEM, VIDEO OUTPUT DEVICE, AND CONTROL METHOD OF DISPLAY DEVICE

TECHNICAL FIELD

The present invention relates to a display device, a display system, a video output device, and a control method of a display device.

BACKGROUND ART

Liquid crystal display devices include liquid layers and backlight devices. The backlight device of a liquid crystal display device is a device using white light or a device configured to emit white light mixing three primary colors (e.g. red, green, and blue). A backlight having light sources of three colors is designed to vary a balance of luminance among three colors so as to adjust a white balance (i.e. a chromaticity of white spots) (see Patent Literature Document 1).

It is preferable for display devices, configured to display graphic images such as pictures and illustrations, to constantly maintain a desired luminance and a desired chromaticity, which are preferred by users, for a long time. To constantly maintain a desired chromaticity, it is necessary for display devices, which are applied to the above uses and which are equipped with backlights each having light sources of three colors, to drive the light sources so as to achieve a desired balance of luminance among the light sources of three colors.

CITATION LIST

Patent Literature Document

Patent Literature Document 1: Japanese Patent Application Publication No. H05-127620

SUMMARY OF INVENTION

Technical Problem

Generally speaking, however, display devices may differ from each other in terms of degrees of degradation for each light source. In a backlight using LEDs (Light-Emitting Diodes) of three colors, i.e. red, green, and blue, for example, a red-color LED may start to be firstly reduced in luminance. Next, a green-color LED will start to be reduced in luminance. For this reason, when a single light source starts to be reduced in luminance, it is necessary to reduce the luminance of other light sources in correspondence with the luminance of a light source which starts to be reduced. Thus, display devices which need to constantly maintain a chromaticity suffer from a problem in that a time of maintaining a luminance is extremely short. For example, normal-use display devices which do not need to maintain a chromaticity may demonstrate a luminance life of thirty thousands hours while display devices which need to maintain a chromaticity may demonstrate a luminance life of eight thousands hours (due to differences of control characteristics in similar display devices).

The present invention is created in consideration of the above problem, and therefore it is an object of the invention to provide a display device which is able to improve a time of maintaining a luminance selected by a user as well as a display system, a video output device, and a control method of a display device.

Solution to Problem

To achieve the above object, the present invention is directed to a display device including an emission part further including a first light source emitting a first light, a second light source emitting a second light having a longer wavelength than the first light, and a fluorescent substance which is excited by the first light and the second light so as to emit a third light, and a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources.

To achieve the above object, the present invention is directed to a display system including a display device and a video output device. The display device includes an emission part further including a first light source emitting a first light, a second light source emitting a second light having a longer wavelength than the first light, and a fluorescent substance which is excited by the first light and the second light so as to emit a third light. The video output device includes a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources.

To achieve the above problem, the present invention is directed to a video output device including a controller configured to generate a drive value of a first light source and a drive value of a second light source based on a luminance of a first light emitted by the first light source, a luminance of a second light, having a longer wavelength than the first light, emitted by the second light source, a luminance of a third light emitted by a fluorescent substance being excited by the first light and the second light, a first target luminance for the first light source, a second target luminance for the second light source, and a third target luminance for the fluorescent substance, thus controlling two light sources based on the drive values of the first and second light sources.

To achieve the above object, the present invention is directed to a control method of a display device implementing a procedure of generating a drive value of a first light source and a drive value of a second light source based on a luminance of a first light emitted by the first light source, a luminance of a second light, having a longer wavelength than the first light, emitted by the second light source, a luminance of a third light emitted by a fluorescent substance being excited by the first light and the second light, a first target luminance for the first light source, a second target luminance for the second light source, and a third target luminance for the fluorescent substance; and a procedure of controlling two light sources based on the drive values of the first and second light sources.

Advantageous Effects of Invention

A display device according to the present invention is able to improve a time of maintaining a luminance selected by a user.

DESCRIPTION OF EMBODIMENTS

First Embodiment

Hereinafter, the present invention will be described in detail by way of the embodiments with reference to the drawings.

Figure 1:
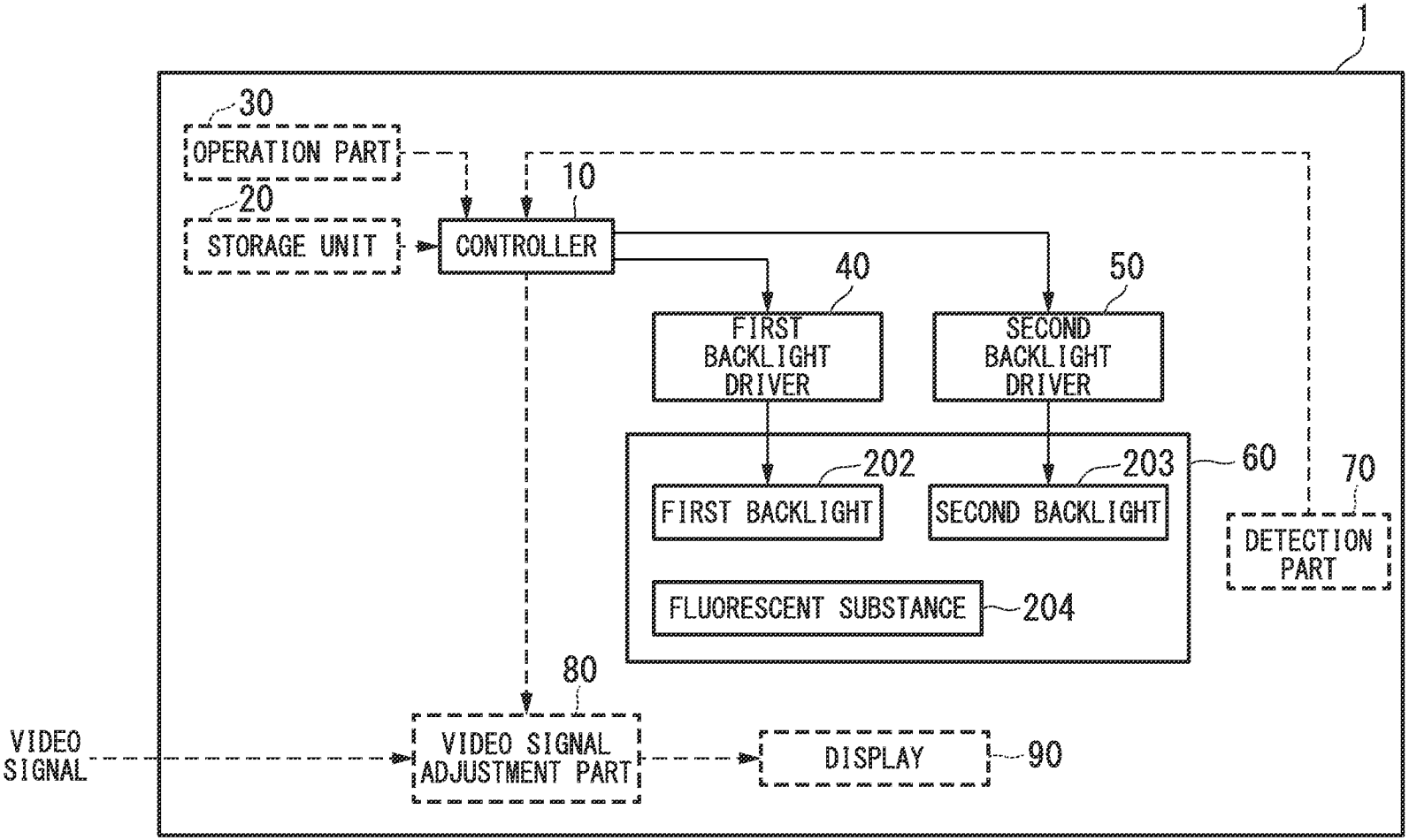
FIG. 1 is a block diagram showing the outline configuration of a backlight device according to a first embodiment.

FIG. 1 is a block diagram showing the outline configuration of a display device 1 of the first embodiment. As shown in FIG. 1, the display device 1 includes a controller 10, a storage unit 20, an operation part 30, a first backlight driver 40, a second backlight driver 50, a backlight 60, a detection part 70, a video signal adjustment part 80, and a display 90.

The controller 10 compares the luminance (or the measured luminance) detected by the detection part 70 with the target luminance stored in the storage unit 20 so as to generate the drive values for first and second backlights, which will be discussed later, and a video signal control value based on the comparison result. The controller 10 outputs the generated drive values to the first backlight driver 40 and the second backlight driver 50. The controller 10 outputs the generated video signal control value to the video signal adjustment part 80. In this connection, the method of generating drive values will be discussed later.

The storage unit 20 stores a target luminance and a target chromaticity. For example, the target chromaticity is a white color temperature which is determined based on the screen, displaying a target chromaticity, according to the user's setting. For example, a color temperature is selected from among 5,000 K (Kelvin), 6,500 K, 9,300 K, and the like, or a color temperature is defined using a Kelvin value selected by a user. Alternatively, a color temperature is defined using (x,y) values selected by a user. For example, a target luminance is defined using cd (candela)/$m^2$ for each unit area. In this connection, it is possible to store the predetermined value of a target luminance and the predetermined value of a target chromaticity in the storage unit 20 in advance.

The operation part 30 accepts a target luminance and a target chromaticity which are set via a user's operation so as to store the target luminance and the target chromaticity in the storage unit 20. For example, the operation part 30 may include switches or a remote-control light receiver installed in a main body.

The backlight 60 includes a first backlight 202, a second backlight 203, and a florescent substance 204.

For example, the first backlight 202 is a green LED. For example, the second backlight 203 is a blue LED. For example, the fluorescent substance 204 is a fluorescent substance of a red color gamut, which is excited to emit a red light when the first backlight 202 and the second backlight 203 are turned on. The fluorescent substance 204 may be a fluorescent substance of a yellow color gamut. For example, the red color gamut ranges from about 620 nm to 750 nm. The yellow color gamut ranges from about 570 nm to 590 nm. The present embodiment will be described using an example in which the first backlight 202 is a green LED, the second backlight 203 is a blue LED, and the fluorescent substance 204 is a red fluorescent substance. In the following description, the first backlight 202 will be referred to as a green LED 202G while the second backlight 203 will be referred to as a blue LED 203B.

The first backlight driver 40 drives the first backlight 202 based on a drive value generated by the controller 10. The second backlight driver 50 drives the second backlight 203 based on a drive value generated by the controller 10.

The detection part 70 detects a luminance of the backlight 60 so as to output the detected luminance (or the measured luminance) to the controller 10. In this connection, the detection part 70 may include color sensors suiting to wavelengths of blue, green, and red so as to detect a luminance for each color, thus outputting the luminance for each color to the controller 10. The detection part 70 may normally detect a luminance, or the detection part 70 may periodically detect a luminance in the predetermined cycle. Alternatively, the detection part 70 may detect a luminance upon a user's request to detect a luminance.

The video signal adjustment part 80 controls the magnitude of a video signal, being input from an external device, based on a video signal control value output from the controller 10, thus displaying the controlled video signal on the display 90.

The display 90 displays a video under the control of the video signal adjustment part 80. For example, the display 90 is a liquid crystal panel of a TFT (Thin Film Transistor) type. The display elements installed in the display 90 can be any display element other than liquid crystals, such as organic electroluminescence display elements, inorganic electroluminescence display elements, and projectors employing PALC (Plasma Address Liquid Crystal), PDP (Plasma Display Panel), FED (Field Emission Display), and DMD (Digital Micro-mirror Device).

Figure 2:
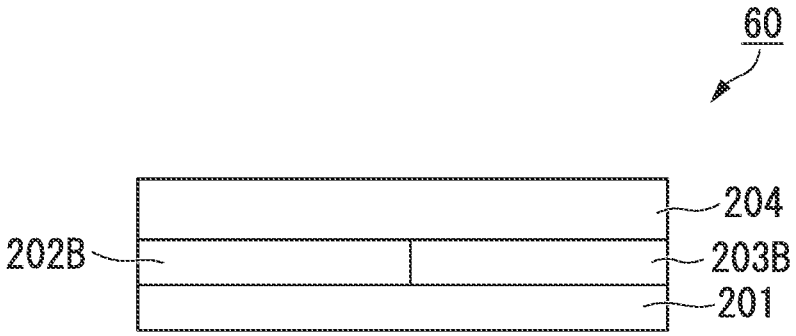
FIG. 2 is a cross-sectional view of a light source used for the backlight device of the first embodiment.

FIG. 2 is a cross-sectional view of a light source used for the backlight 60 of the present embodiment. As shown in FIG. 2, the backlight 60 includes a substrate 201, a green LED 202G, a blue LED 203B, and a florescent substance 204. The green LED 202G is formed on the substrate 201. The blue LED 203B is formed on the substrate 201. The fluorescent substance 204 is formed on the green LED 202G and the blue LED 203B. In the display device 1, a plurality of backlights 60 is arranged in the periphery of the display 90, and therefore the lights emitted by these light sources are diffused to illuminate the display 90.

The backlight 60 having the structure shown in FIG. 2 is able to emit red light in addition to green light when the green LED 202G is turned on. When the blue LED 203B is turned on, it is possible to emit red light in addition to blue light. As described above, when the green LED 202G and the blue LED 203B are turned on in the backlight 60, it is possible to turn on green color and blue color while exciting red color with the fluorescent substance 204. The backlight 60 generates white light mixing lights of three colors.

For example, the center wavelength of red light is about 680 nm; the center wavelength of green light is about 520 nm; and the center wavelength of blue light is about 470 nm. Therefore, the backlight 60 shown in FIG. 2 employs the fluorescent substance 204 serving as a light source having the longest wavelength among three colors used to achieve white color.

Figure 3:
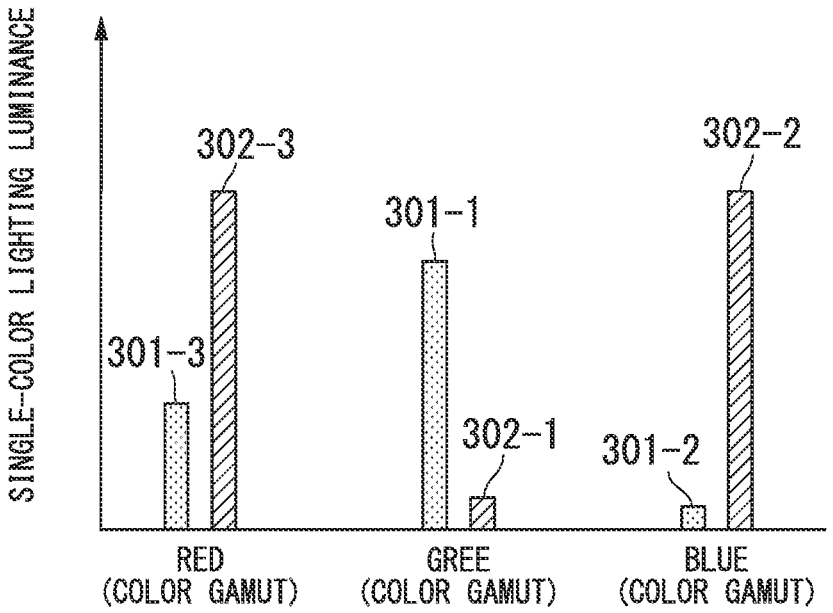
FIG. 3 is a graph used to explain an example of contributions of backlights at spots of RGB primary colors in terms of the color gamut of light sources in a display according to the first embodiment.

FIG. 3 is a graph used to explain an example of contributions of backlight colors at an RGB origin in the color gamut of the display 90 according to the present embodiment. In FIG. 3, the vertical axis represents the luminance which is produced when each of the green LED 202G and the blue LED 203B is solely turned on based on the same power. Additionally, reference signs 301-1 to 301-3 represent the luminance which is produced when the green LED 202G is turned on. Reference signs 302-1 to 302-3 represents the luminance which is produced when the blue LED 203B is turned on.

As shown in FIG. 3, the luminance 301-1 of the green LED 202G contributes to the green color gamut. At this time, the luminance 302-1 of the blue LED 203B occurs due to color leakage. The luminance 302-2 of the blue LED 203B contributes to the blue color gamut. At this time, the luminance 301-2 of the green LED 202G occurs due to color leakage.

The luminance 301-3 of the green LED 202G and the luminance 302-3 of the blue LED 203B contribute to the red color gamut. For example, a contribution of the luminance of the blue LED 203B is 80% while a contribution of the luminance of the green LED 202G is 20%. In other words, the blue LED 203B has a four times higher efficiency than the green LED 202G in connection with an operation to produce red light based on the constant power.

Figure 4:
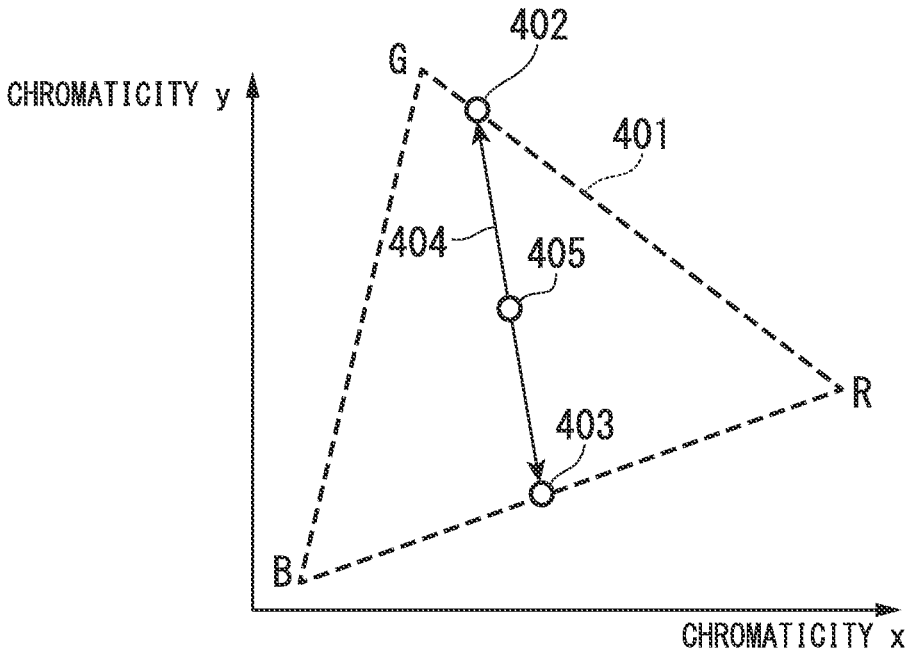
FIG. 4 is a graph used to explain a varying range of white spots in the backlight device of the first embodiment.

FIG. 4 is a graph used to explain a varying range of white spots in the backlight device of the present embodiment. FIG. 4 is an XY chromaticity diagram in the CIE1931 (XYZ) colorimetric system, in which the horizontal axis represents a chromaticity x while the vertical axis represents a chromaticity y. In the chromaticity diagram of FIG. 4 in the CIE1931 colorimetric system, vertices R, G, B of a triangle 401 correspond to R (red), G (green), B (blue). The area encompassed by the triangle 401 represents a color space which can be rendered using the display 90.

As shown in FIG. 3, red light is produced in addition to green light at a point 402 representing a chromaticity which is produced when the green LED 202G is turned on, and therefore the point 402 is placed at a position between the vertices G and R. Similarly, red light is produced in addition to blue light at a point 403 representing a chromaticity which is produced when the blue LED 203B is turned on, and therefore the point 403 is placed at a position between the vertices B and R. For this reason, it is possible to move a white point 405 along a straight line 404 connected between the points 402 and 403 so as to change a chromaticity by changing the light-emission ratios of the green LED 202G and the blue LED 203B.

As shown in FIGS. 3 and 4, the backlight 60 is unable to solely turn on red color. It is possible to produce plenty of combinations, concerning the light-emission efficiencies of the green LED 202G and the blue LED 203B, achieving the target luminance of red color. For this reason, it is difficult to univocally determine the light-emission efficiencies achieving the target luminance of red color.

According to the following process, the present embodiment determines the light-emission efficiencies of the green LED 202G and the blue LED 203B so as to achieve a user's specified luminance.

Figure 5:
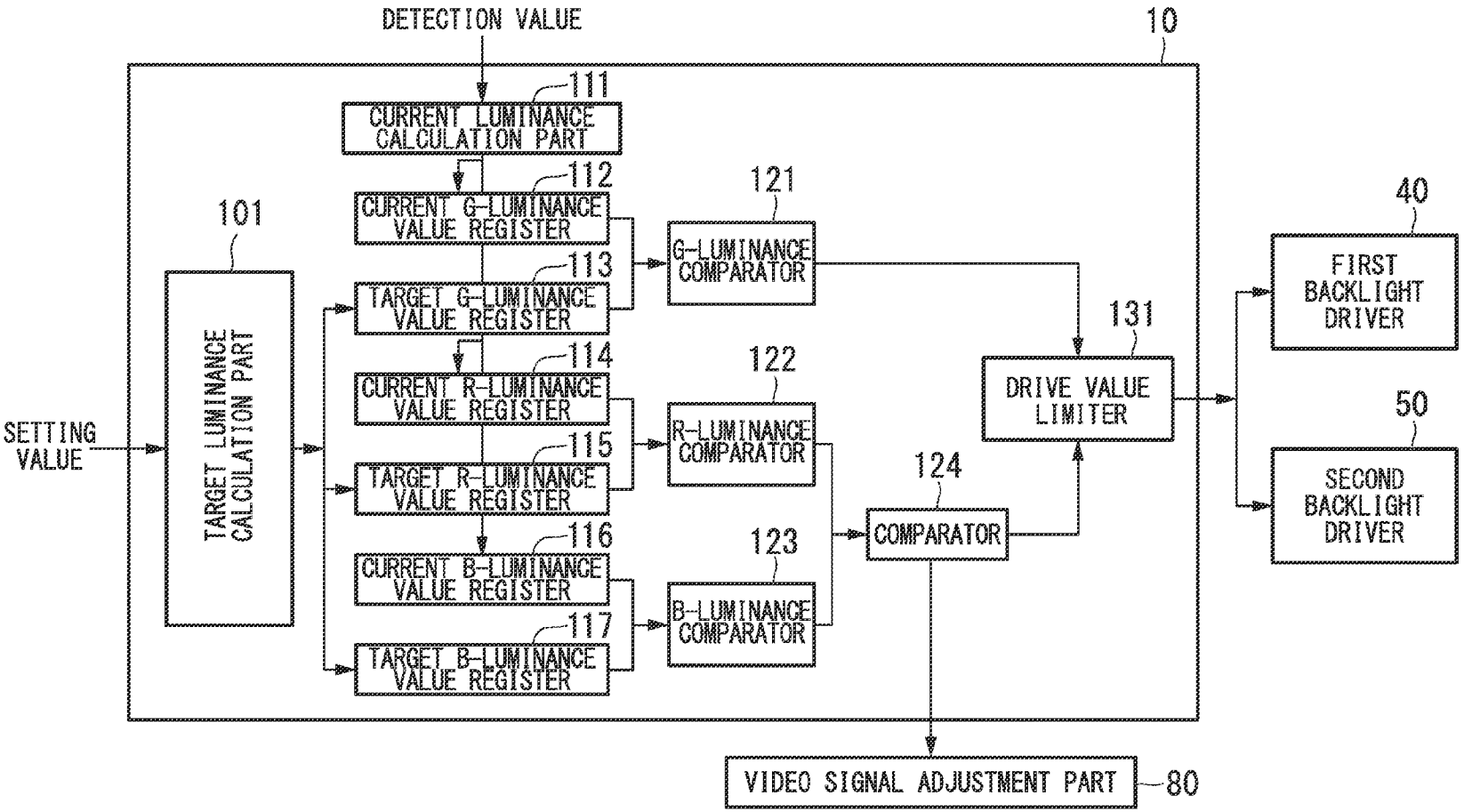
FIG. 5 is a block diagram showing an example of the configuration of a controller according to the first embodiment.

FIG. 5 is a block diagram showing an example of the configuration of the controller 10 according to the present embodiment. As shown in FIG. 5, the controller 10 includes a target luminance calculation part 101, a current luminance calculation part 111, a current G-luminance value register 112, a target G-luminance value register 113, a current R-luminance value register 114, a target R-luminance value register 115, a current B-luminance value register 116, a target B-luminance value register 117, a G-luminance comparator 121, an R-luminance comparator 122, a B-luminance comparator 123, a comparator 124, and a drive value limiter 131.

The target luminance calculation part 101 reads a target luminance Y and a target chromaticity (x,y) stored in the storage unit 20, thus calculating the target luminance for each of RGB colors based on the target luminance and the target chromaticity. For example, the target luminance calculation part 101 converts Yxy into CIE tristimulus values XYZ in accordance with Equations (1) to (3).

$$x=X/(X+Y+Z) \tag{1}$$

$$y=Y/(X+Y+Z) \tag{2}$$

$$z=Z/(X+Y+Z) \tag{3}$$

Next, the target luminance calculation part 101 assigns the values, which are produced by dividing the converted XYZ values by 100, to Equation (4) so as to calculate linear RGB values.

[Equation 1]

$$R=3.5064-X-1.7400\times Y-0.5441\times Z$$

$$G=-1.0690\times X+1.9777\times Y+0.0352\times Z$$

$$B=0.0563\times X-0.1970\times Y+1.0511\times Z \tag{4}$$

In this connection, Equations (1) to (4) are used to explain how to convert CIE tristimulus values XYZ into RGB values; however, various coefficients can be presented for the RGB-XYZ conversion. This is not a restriction; hence, it is possible to carry out conversion using other color spaces, e.g. Lab values or YCbCr values.

The target luminance calculation part 101 stores a target G-luminance value, i.e. a luminance corresponding to the calculated green-color wavelength, in the target G-luminance value register 113. The target luminance calculation part 101 stores a target R-luminance value, i.e. a luminance corresponding to the calculated red-color wavelength, in the target R-luminance value register 115. The target luminance calculation part 110 stores a target B-luminance value, i.e. a luminance corresponding to the calculated blue-color luminance, in the target B-luminance value register 117.

The current luminance calculation part 111 calculates a current luminance, i.e. a current luminance for each of RGB colors, based on the measured luminance Y and the chromaticity (x,y) which are output from the detection part 70. Similar to the target luminance calculation part 101, the current luminance calculation part 111 converts the measured Yxy into RGB values in accordance with Equations (1) to (4). The current luminance calculation part 111 stores the measured luminance, corresponding to the calculated green-color wavelength, in the current G-luminance value register 112. The current luminance calculation part 111 stores the measured luminance, corresponding to the calculated red-color wavelength, in the current R-luminance value register 114. The current luminance calculation part 111 stores the measured luminance, corresponding to the calculated blue-color wavelength, in the current B-luminance value register 116.

The current G-luminance value register 112 stores the current G-luminance value, i.e. the measured luminance corresponding to the green-color wavelength calculated by the current luminance calculation part 111.

The target G-luminance value register 113 stores the target G-luminance value calculated by the target luminance calculation part 101.

The current R-luminance value register 114 stores the current R-luminance value, i.e. the measured luminance corresponding to the red-color wavelength calculated by the current luminance calculation part 111.

The target R-luminance value register 115 stores the target R-luminance value calculated by the target luminance calculation part 101.

The current B-luminance value register 116 stores the current B-luminance value, i.e. the measured luminance corresponding to the blue-color wavelength calculated by the current luminance calculation part 111.

The target B-luminance value register 117 stores the target B-luminance value calculated by the target luminance calculation part 101.

The G-luminance comparator 121 compares the current G-luminance value stored in the current G-luminance value register 112 with the target G-luminance value stored in the target G-luminance value register 113, thus producing a G-output value, i.e. a drive value of the green LED 202, based on the comparison result. The G-luminance comparator 121 outputs the G-drive value to the drive value limiter 131.

The R-luminance comparator 122 compares the current R-luminance value stored in the current R-luminance value register 114 with the target R-luminance value stored in the target R-luminance value register 115, thus outputting the R-comparison result to the comparator 124.

The B-luminance comparator 123 compares the current B-luminance value stored in the current B-luminance value register 116 with the target B-luminance value stored in the target B-luminance value register 117, thus outputting the B-comparison result to the comparator 124.

The comparator 124 compares the R-comparison result output from the R-luminance comparator 122 with the B-comparison result output from the B-luminance comparator 123 so as to generate a B-drive value, i.e. a drive value of the blue LED 203, based on the comparison result. The comparator 124 outputs the B-drive value to the drive value limiter 131. Based on the comparison result, the comparator 124 generates a gain instruction of a B signal (which will be referred to as a B-video gain) or a gain instruction of an R signal (which will be referred to as an R-video gain) among RGB video signals, thus outputting a gain instruction of a B signal or an R signal as a video signal control value to the video signal adjustment part 80.

The drive value limiter 131 calculates the total power of the backlight 60 based on the G-drive value output from the G-luminance comparator 121 and the B-drive value output from the comparator 124. The drive value limiter 131 limits the G-drive value and the B-drive value such that the calculated total power will become equal to or lower than the predetermined power. For example, the predetermined power is a rated power of the backlight 60. In this connection, the drive value limiter 131 may calculate the temperatures of the elements installed in the backlight 60 based on the G-drive value output from the G-luminance comparator 121 and the B-drive value output from the comparator 124. In this case, the drive value limiter 131 limits the B-drive value such that the calculated temperature will become equal to or lower than the predetermined temperature. For example, the predetermined temperature is a rated temperature of the backlight 60. The drive value limiter 131 outputs the limited G-drive value to the first backlight driver 40 while outputting the limited B-drive value to the second backlight driver 50.

Figure 6:
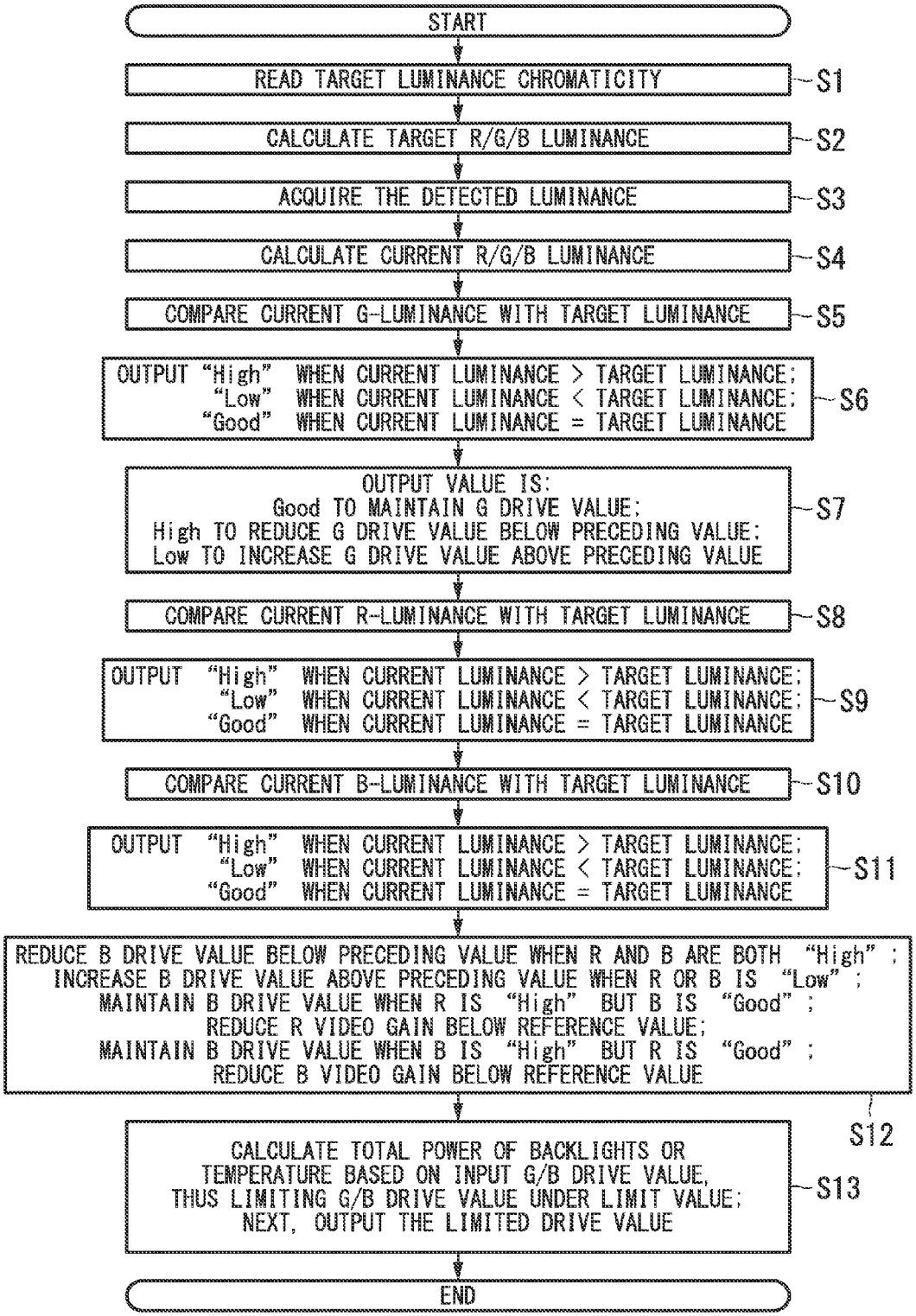
FIG. 6 is a flowchart showing the procedure of a luminance adjusting process according to the first embodiment.

FIG. 6 is a flowchart showing the procedure of a luminance adjustment process according to the present embodiment.

(Step S1) The target luminance calculation part 101 reads the target luminance stored in the storage unit 20.

(Step S2) The target luminance calculation part 101 calculates the target luminance for each of RGB colors based on the read target luminance.

(Step S3) The detection part 70 detects the luminance of the backlight 60 so as to output the measured luminance to the controller 10. Next, the controller 10 acquires the measured luminance output from the detection part 70.

(Step S4) The current luminance calculation part 111 calculates the current luminance, i.e. the current luminance for each of RGB colors, based on the measured luminance.

(Step S5) The G-luminance comparator 121 compares the current G-luminance value stored in the current G-luminance value register 112 with the target G-luminance value stored in the target G-luminance value register 113.

(Step S6) The G-luminance comparator 121 generates a G-drive value, i.e. the information High, based on the comparison result indicating that the current G-luminance value is higher than the target G-luminance value. The G-luminance comparator 121 generates a G-drive value, i.e. the information Low, based on the comparison result indicating that the current G-luminance value is lower than the target G-luminance value. The G-luminance comparator 121 generates a G-drive value, i.e. the information Good, based on the comparison result indicating that the current G-luminance value is equal to the target G-luminance value. The G-luminance comparator 121 outputs the G-drive value to the drive value limiter 131.

(Step S7) When the G-drive value indicates the information Good, the G-luminance comparator 121 does not change the G-drive value from the preceding value so as to directly output the G-drive value to the drive value limiter 131. When the G-drive value indicates the information High, the G-luminance comparator 121 reduces the G-drive value below the preceding value so as to output the G-drive value to the drive value limiter 131. When the G-drive value indicates the information Low, the G-luminance comparator 121 increases the G-drive value above the preceding value so as to output the G-drive value to the drive value limiter 131.

The G-luminance comparator 121 repeats a series of steps S1 to S7 so as to adjust the G-drive value of the green-color LED 202G until the G-comparison result of step S6 becomes Good.

(Step S8) The R-luminance comparator 122 compares the current R-luminance value stored in the current R-luminance value register 114 with the target R-luminance value stored in the target R-luminance value register 115.

(Step S9) When the current R-luminance value is higher than the target R-luminance value, the R-luminance comparator 122 outputs the R-comparison result, i.e. the information High, to the comparator 124. When the current R-luminance value is lower than the target R-luminance value, the R-luminance comparator 122 outputs the R-comparison result, i.e. the information Low, to the comparator 124. When the current R-luminance value is equal to the target R-luminance value, the R-luminance comparator 122 outputs the R-comparison result, i.e. the information Good, to the comparator 124.

(Step S10) The B-luminance comparator 123 compares the current B-luminance value stored in the current B-luminance value register 116 with the target B-luminance value stored in the target B-luminance value register 117.

(Step S11) When the current B-luminance value is higher than the target B-luminance value, the B-luminance comparator 123 outputs the B-comparison result, i.e. the information High, to the comparator 124. When the current B-luminance value is lower than the target B-luminance value, the B-luminance comparator 123 outputs the B-comparison result, i.e. the information Low, to the comparator 124. When the current B-luminance value is equal to the target B-luminance value, the B-luminance comparator 123 outputs the B-comparison result, i.e. the information Good, to the comparator 124.

The comparator 124 carries out the following process based on the R-comparison result output from the R-luminance comparator 122 and the B-comparison result output from the B-luminance comparator 123. When both the R-comparison result and the B-comparison result indicate the information High, the comparator 124 reduces the B-drive value below the preceding value so as to output the B-drive value to the drive value limiter 131. When either the R-comparison result or the B-comparison result indicates the information Low, the comparator 124 reduces the B-driver value below the preceding value so as to output the B-drive value to the drive value limiter 131. When the R-comparison result indicates the information High while the B-comparison result indicates the information Good, the comparator 124 maintains the B-drive value but reduces an R-video gain below a reference value so as to output the R-video gain to the video signal adjustment part 80. When the B-comparison result indicates the information High while the R-comparison result indicates the information Good, the comparator 124 maintains the B-drive value but reduces a B-video gain below a reference value so as to output the B-video gain to the video signal adjustment part 80. In this connection, the reference values are determined to achieve a desired balance of chromaticity set at the shipment.

(Step S13) The drive value limiter 131 calculates the total power or the element temperature in the backlight 60 based on the G-drive value output from the G-luminance comparator 121 and the B-drive value output from the comparator 124. The drive value limiter 131 limits the G-drive value and the B-drive value such that the calculated total power will become equal to or lower than the predetermined power. For example, the predetermined power is a rated power of the backlight 60. Additionally, the predetermined temperature is a rated temperature of the element of the backlight 60. The drive value limiter 131 outputs the limited G-drive value to the first backlight driver 40 while outputting the limited B-drive value to the second backlight driver 50.

An example of step S13 will be described with respect to the case in which the calculated power of the green-color LED 202G is 30 W while the calculated power of the blue-color LED 203B is 30 W although the rated power of the backlight 60 is 50 W. In this case, the drive value limiter 131 limits the G-drive value to 25 W (=30 W×5/6) while limiting the B-drive value to 25 W (=30 W×5/6) such that the total power of 60 W will fall within the rated power of 50 W. Alternatively, the drive value limiter 131 limits the G-drive value and the B-drive value such that the calculated temperature will become equal to or lower than the rated temperature. When a luminance ratio between backlight colors does not match a target luminance ratio due to the limitation of drive values, the video signal adjustment part 80 suppresses a gain for each of RGB video signals, corresponding to a backlight color whose luminance exceeds a target balance, to achieve a target luminance ratio in response to an instruction from the controller 10.

The first backlight driver 40 drives the first backlight 202 (i.e. the green-color LED 202G) based on the G-drive value output from the drive value limiter 131. The second backlight driver 50 drives the second backlight 203 (i.e. the blue-color LED 203B) based on the B-drive value output from the drive value limiter 131. The video signal adjustment part 80 adjusts a gain for each video signal in response to a video control signal, i.e. a gain instruction concerning an R-video signal or a B-video signal output from the comparator 124.

As shown in FIG. 6, it is possible to conclude the luminance adjustment process on the condition that the R-comparison result indicates the information High while the B-comparison result indicates the information Good or on the condition that the B-comparison result indicates the information High while the R-comparison result indicates the information Good.

Next, the reason why the present embodiment can complete the luminance adjustment even when the R-comparison result is High while the B-comparison result is Good since the current B-luminance value matches the target B-luminance value will be explained. A certain color balance being set by a user may cause the current R-luminance value to over the target R-luminance value. For this reason, the present embodiment can complete the luminance adjustment even when the R-comparison result is High while the B-comparison result is Good since the current B-luminance value matches the target B-luminance value. This example needs to increase the B-drive value of the blue LED 203B so as to make the current R-luminance value approach the target R-luminance value. When the current R-luminance value matches the target R-luminance value but the current B-luminance value does not reach the target B-luminance value, the controller 10 repeats a series of steps S1 to S12 until the B-comparison result becomes Good since the current B-luminance value matches the target B-luminance value. Due to the adjustment, the B-comparison result becomes Good while the R-comparison result is High. Since the current R-luminance value is equal to or higher than the target R-luminance value, the video signal adjustment part 80 reduces a gain of an R signal among RGB video signals, thus adjusting the current R-luminance value to approach the target R-luminance value.

Figure 7:
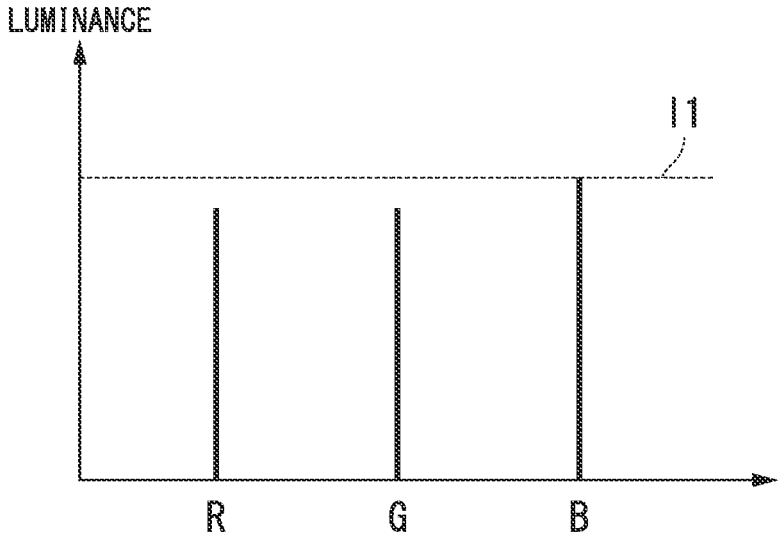
FIG. 7 is a graph used to explain an example of the RGB luminance before the luminance adjustment according to the first embodiment.
Figure 8:
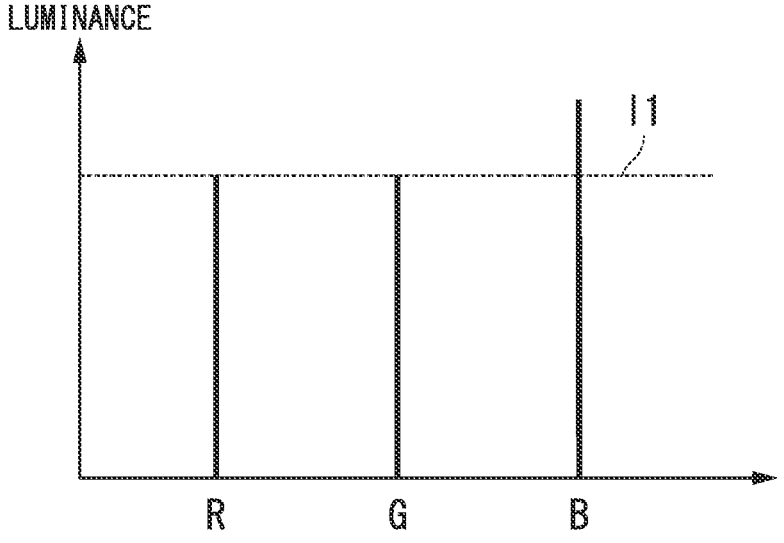
FIG. 8 is a graph used to explain an example of the RGB luminance after the luminance adjustment according to the first embodiment.

Hereinafter, an example of the luminance adjustment performed by the display device 1 will be described. FIG. 7 is a graph used to explain an example of the luminance for each of RGB colors before the luminance adjustment of the present embodiment. FIG. 8 is a graph used to explain an example of the luminance for each of RGB colors after the luminance adjustment of the present embodiment. In the following example, as shown in FIG. 7, the current luminance of the red color detected by the detection part 70 becomes lower than the target luminance due to the aged degradation of the backlight 60. In the example of FIG. 7, the current luminance of the green color is lower than the target luminance while the current luminance of the green color is equal to the target luminance. In FIGS. 7 and 8, the vertical axis represents the luminance while the dashed line 11 indicates the target luminance.

The target luminance calculation part 101 reads the target luminance stored in the storage unit 20 (step S1) so as to calculate the target luminance for each of RGB colors based on the read target luminance (step S2). Herein, it is assumed that the target luminance of the red color corresponds to a target R-luminance value R11; the target luminance of the green color corresponds to a target G-luminance value G11; and the target luminance of the blue color corresponds to a target B-luminance value B11.

Based on the measured luminance output from the detection part 70 (step S3), the current luminance calculation part 111 calculates the current luminance for each of RGB colors (step S4). Herein, it is assumed that the current luminance of the red color corresponds to a current R-luminance value R12; the current luminance of the green color corresponds to a current G-luminance value G12; and the current luminance of the blue color corresponds to a current B-luminance value B12.

The G-luminance comparator 121 compares the current G-luminance value G12 with the target G-luminance value G11 (step S5). In this example, the G-luminance comparator 121 generates a G-drive value representing the information Low since the current G-luminance value G12 is lower than the target G-luminance value G11 (step S6). The G-luminance comparator 121 repeats a series of steps S1 to S7 so as to adjust the G-drive value of the green LED 202G until the current G-luminance value matches the target G-luminance value to produce the result Good in step S6.

That is, the G-luminance comparator 121 may solely adjust the drive value for the green color to match the target luminance value irrespective of the luminance for each of the red and blue colors.

Next, the R-luminance comparator 122 compares the current R-luminance value R12 with the target R-luminance value R11 (step S8). In this example, the R-luminance comparator 122 produces the information Low as the R-comparison result so as to output the information Low to the comparator 124 since the current R-luminance value R12 is lower than the target R-luminance value (step S9).

Next, the B-luminance comparator 123 compares the current B-luminance value B12 with the target B-luminance value B11 (step S10). In this example, the B-luminance comparator 123 produces the information Good as the B-comparison result so as to output the information Good to the comparator 124 since the current B-luminance value B12 is equal to the target B-luminance value B11 (step S11).

Next, the comparator 124 increases the B-drive value above the preceding value so as to output the B-drive value to the drive value limiter 131 since the R-comparison result corresponds to the information Low while the B-comparison result corresponds to the information Good (step S12).

The controller 10 repeats a series of step S1 to S12 so as to adjust the B-drive value of the blue LED 203B until either the R-comparison result or the B-comparison result becomes Good in step S9 or S11.

In this example, the B-comparison result corresponds to the information High while the R-comparison result corresponds to the information Good due to the repeated execution of the steps S1 to S12, and therefore the comparator 124 determines the B-drive value as Good so as to output the B-drive value to the drive value limiter 131. Additionally, the comparator 124 outputs a video control signal, used to reduce a gain of a B (blue) signal among video signals for RGB colors, to the video signal adjustment part 80 (step S12).

Next, the drive value limiter 131 calculates the total power of the backlight 60 based on the G-drive value output from the G-luminance comparator 121 and the B-drive value output from the comparator 124. Herein, it is assumed that the total power calculated by the drive value limiter 131 is lower than the predetermined power. Next, the drive value limiter 131 outputs the G-drive value to the first backlight driver 40 while outputting the B-drive value to the second backlight driver 50 (step S13).

According to the above process using a certain color balance, as shown in FIG. 8, the current R-luminance value is adjusted to the target R-luminance value while the current G-luminance value is adjusted to the target G-luminance value. In contrast, the current B-luminance value becomes higher than the target B-luminance value. Thus, the controller 10 reduces a gain of a B signal by an amount of the current B-luminance higher than the target B-luminance value, thus adjusting the current B-luminance value to the target B-luminance value.

Figure 9:
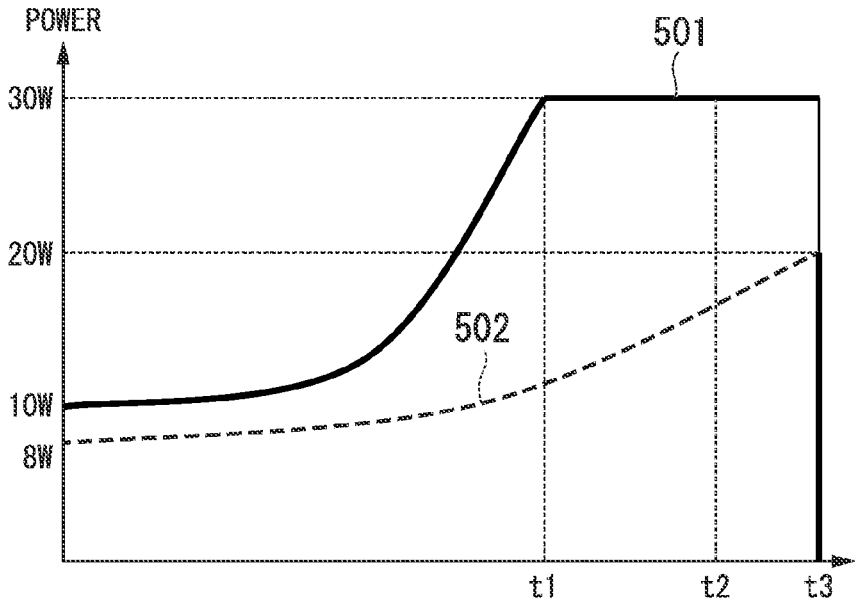
FIG. 9 is a graph used to explain an example of power variance relative to the emission time of a green LED in a comparison between the first embodiment and a comparative example.
Figure 10:
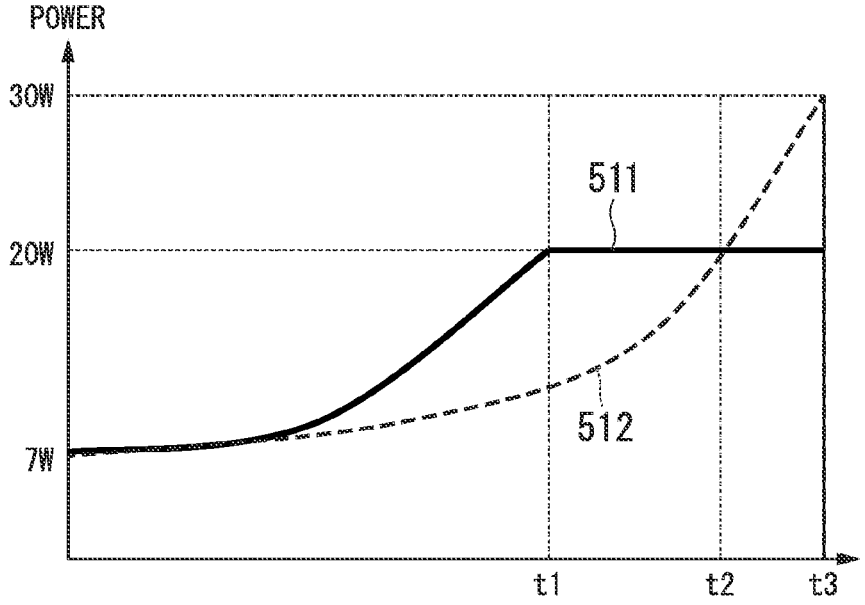
FIG. 10 is a graph used to explain an example of power variance relative to the emission time of a blue LED in a comparison between the first embodiment and a comparative example.
Figure 11:
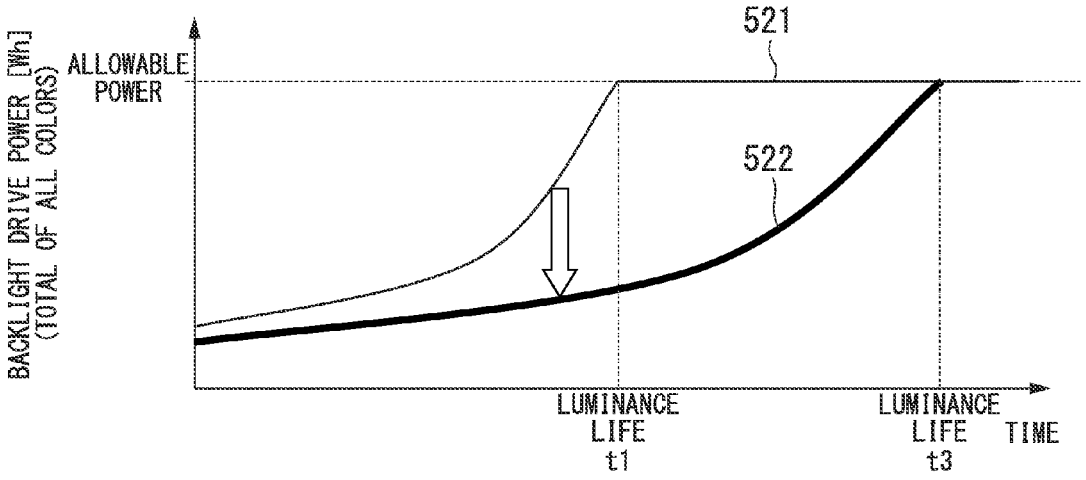
FIG. 11 is a graph used to explain an example of power variance relative to the emission time of a backlight in a comparison between the first embodiment and a comparative example.

Next, power variances with respect to the emission times of the green LED 202G and the blue LED 203B in the display device 1 of the present embodiment will be described. FIG. 9 is a graph used to explain an example of power variance relative to the emission time of a green LED in a comparison between the present embodiment and a comparative example. FIG. 10 is a graph used to explain an example of power variance relative to the emission time of a blue LED in a comparison between the present embodiment and a comparative example. FIG. 11 is a graph used to explain an example of power variance relative to the emission time of a backlight in a comparison between the present embodiment and a comparative example. In FIGS. 9, 10, and 11, the vertical axis represents time while the horizontal axis represents power.

In FIG. 9, a curve 501 shows a power characteristic relative to the emission time of the green LED 202G in the comparative example. Additionally, a curve 502 shows a power characteristic relative to the emission time of the green LED 202G in the present embodiment. In FIG. 10, a curve 511 shows a power characteristic relative to the emission time of the blue LED 203B in the comparative example. Additionally, a curve 512 shows a power characteristic relative to the emission time of the blue LED 203G in the present embodiment. In FIG. 11, a curve 521 shows a power characteristic relative to the emission time of the backlight 60 in the comparative example, while a curve 522 shows a power characteristic relative to the emission time of the backlight 60 in the present embodiment.

The comparative example adjusts the current R-luminance value to match the target R-luminance value without changing a ratio between the drive values of the green LED 202G and the blue LED 203B when the current R-luminance value becomes lower than the target R-luminance value. Thus, it is possible to drive the current G-luminance value to be higher than the target G-luminance value since the comparative example adjusts the current R-luminance value to match the target R-luminance value without changing a ratio between the drive values of the green LED 202G and the blue LED 203B. Thus, the video signal adjustment part 80 adjusts the level of a G-video signal by an amount of the current G-luminance value exceeding the target G-luminance value.

The life of a luminance (hereinafter, referred to as a luminance life) of the backlight 60 depends on the timing at which the total power of the green LED 202G and the blue LED 203B reaches the rated power (hereinafter, referred to as an allowable power). In the comparative example shown in FIGS. 9 and 10, the power of the green LED 202G reaches 30 W while the power of the blue LED 203B reaches 20 W at time t1. Considering that the allowable power of the backlight 60 is 50 W, the luminance life is set to time t1 as shown by the curve 521 of FIG. 11 in the comparative example. For example, the time t1 is 8,000 hours.

The present embodiment is designed to independently drive the green LED 202G and the blue LED 203B. In the initial condition, the present embodiment drives the blue LED 203B with the higher emission efficiency than the green LED 202G so as to increase the luminance of the blue LED 203B, thus making the current R-luminance value match the target R-luminance value. Compared to the comparative example, the present embodiment drives the green LED 202G with a reduced power in the initial condition.

As a result, as shown by the curve 502 of FIG. 9, the power of the green LED 202G is about 8 W in the initial condition; the power of the green LED 202G is increased to about 10 W at time t1, and then it is further increased to about 20 W at time t3. For this reason, the luminance life of the present embodiment is set to time t3 as shown by the curve 522 of FIG. 11. For example, the time t3 is 30,000 hours.

The present embodiment reduces the powers of the green LED 202G and the blue LED 203B to be lower than the powers of the comparative example in a period between time 0 and time t1 and in a period between time t1 and time t2; hence, it is possible to alleviate the degradation of the light sources. Additionally, the present embodiment controls the total power of the backlight 60 within the range of the rated power since the present embodiment reduces the power of the green LED 202G to be lower than the power of the comparative example in a period between time t2 and time t3. As a result, it is possible to extend the luminance life since the present embodiment is able to increase the power of the blue LED 203B to be higher than the power of the comparative example in the period between time t2 and time t3.

Figure 12:
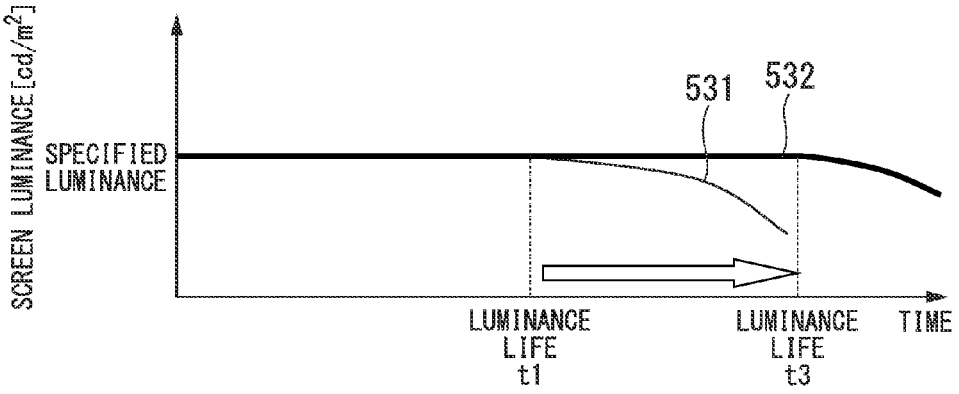
FIG. 12 is a graph used to explain luminance variance with respect to time in a comparison between the first embodiment and a comparative example.

The reason why the present embodiment can significantly extend the luminance life of the curve 522 to be longer than the curve 521 of the comparative example in FIG. 11 will be described. FIG. 12 is a graph used to explain luminance variances with respect to time in a comparison between the present embodiment and the comparative example. In FIG. 12, the horizontal axis represents time while the vertical axis represents the luminance of the display 90. In FIG. 12, a curve 531 shows a luminance-varying characteristic of the comparative example with respect to time, while a curve 532 shows a luminance-varying characteristic of the present embodiment with respect to time.

As shown in FIGS. 9 and 10, the present embodiment reduces the power of the green LED 202G to be lower than the power of the comparative example in the initial condition (i.e. time 0). Additionally, the present embodiment compensates for a power reduction by use of the blue LED 203B having high emission efficiency; hence, the power of the present embodiment is lower than the power of the comparative example at time 0. When the current R-luminance value becomes lower than the target R-luminance value, the present embodiment increases the luminance of the blue LED 203B so as to adjust the current R-luminance value to match the target R-luminance value. For example, the emission efficiency of the blue LED 203B is about four times higher than the emission efficiency of the green LED 202G, and therefore an amount of power increase may be small irrespective of the increased luminance of the blue LED 203B. Due to a small amount of power increase, the present embodiment is able to reduce an amount of heat, which is generated by the emission of the green LED 202G and the blue LED 203B, to be lower than an amount of heat generated in the comparative example. Due to a reduction in the amount of heat, the present embodiment can prolong the degradation of the fluorescent substance 204 due to heating and the degradation of the green LED 202G and the blue LED 203B to be longer than the degradation of the comparative example. Thus, as shown in FIGS. 9 to 11, it is possible to provide adequate room for the allowable power at time t1 due to a small amount of power increase which may remain at time t1 after time 0. As a result, as shown in FIG. 12, the present embodiment can significantly extend the luminance life, in which the luminance of the backlight 60 can be maintained at a user's specified luminance, to be longer than the luminance life of the comparative example.

As described above, the display device of the present embodiment includes an emission part, including a first light source emitting a first light, a second light source emitting a second light having a longer wavelength than the first light, and a fluorescent substance which is excited by the first light and the second light so as to emit a third light, and a controller which generates a drive value of the first light source and a drive value of the second light source based on a luminance of the first light, a luminance of the second light, and a luminance of the third light as well as a first target luminance of the first light source, a second target luminance of the second light source, and a third target luminance of the fluorescent substance, thus controlling the two light sources based on the drive values of the first and second light sources.

In the display device of the present embodiment, the controller determines a drive value of the second light source so as to adjust the luminance of the second light to the second target luminance.

In the display device of the present embodiment, the controller further increases the drive value of the first light source so as to adjust the luminance of the first light to the first target luminance when the luminance of the first light is smaller than the first target luminance at the time at which the controller determines the drive value of the first light source so as to adjust the luminance of the third light to the third target luminance.

Owing to the above configuration, the display device 1 of the present embodiment can reduce a power for driving the backlight 60 so as to reduce an amount of heat generated by the backlight 60. As a result, the present embodiment can significantly extend the luminance life to be longer than the luminance life of the comparative example.

The present embodiment refers to the display device 1 including the detection part 70; but this is not a restriction. It is possible to employ a color sensor or the like as the detection part 70, and therefore the color sensor attached to the display 90 detects a luminance so as to output the measured luminance to the display device 1.

Second Embodiment

In the first embodiment, the display device 1 configured to adjust a gain of a video signal produces drive values for the first backlight driver 40 and the second backlight driver 50; but this is not a restriction. In the second embodiment, for example, a video signal output device carries out gain adjustment and produces drive values.

Figure 13:
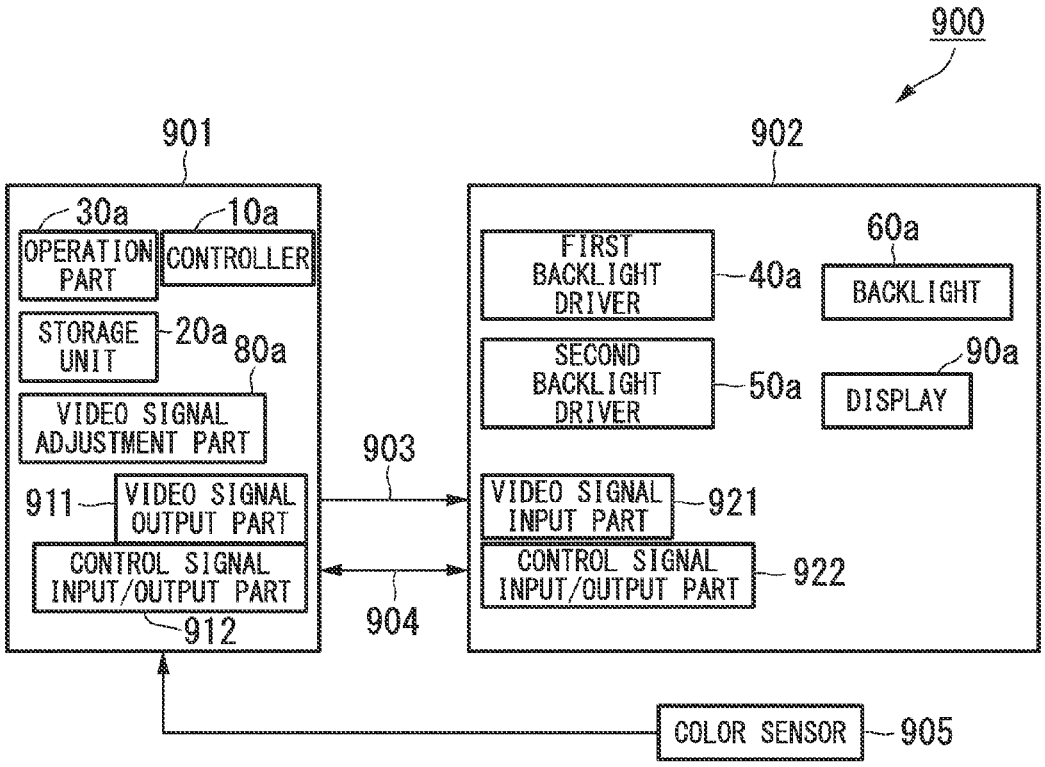
FIG. 13 is a block diagram showing an example of the configuration of an image display system 900 according to a second embodiment.

FIG. 13 is a block diagram showing an example of the configuration of an image display system 900 according to the second embodiment. As shown in FIG. 13, the image display system 900 includes a video output device 901 and a display device 902. The video output device 901 is connected to the display device 902 through a video cable 903 and a control signal cable 904. For example, the control signal cable 904 is a USB (Universal Serial Bus) cable.

A color sensor 905 is attached to the display device 902. The color sensor 905 is a function part corresponding to the detection part 70 of FIG. 1. The color sensor 905 detects a luminance so as to output the measured luminance to the video output device 901.

The video output device 901 includes a controller 10*a*, a storage unit 20*a*, an operation part 30*a*, and a video signal adjustment part 80*a*. Additionally, the video output device 901 includes a video signal output part 911 and a control signal input/output part 912. The controller 10*a*, the storage unit 20*a*, the operation part 30*a*, and the video signal adjustment part 80*a* corresponds to the function parts shown in FIGS. 1 and 5, i.e. the controller 10, the storage unit 20, the operation part 30, and the video signal adjustment part 80. For example, the video output device 901 is a PC (i.e. a personal computer).

Similar to the controller 10 described in the first embodiment, the controller 10*a* calculates the current luminance for each of RGB colors based on the measured luminance output from the color sensor 905. Similar to the first embodiment, the controller 10*a* compares the calculated current luminance for each of RGB colors with the target luminance for each of RGB colors stored in the storage unit 20*a* so as to produce a G-drive value and a B-drive value as well as a gain of a video signal for each of RGB colors based on the comparison result. The controller 10*a* controls the control signal input/output part 912 so as to transmit the G-drive value and the B-drive value to the display device 902. Additionally, the controller 10*a* outputs the gain of a video signal for each of RGB colors to the video signal adjustment part 80*a*.

The video signal adjustment part 80*a* adjusts the gain of a video signal based on the gain of a video signal for each of RGB colors output from the controller 10*a* so as to control the video signal output part 911 to transmit the adjusted video signal to the display device 902.

The display device 902 includes a first backlight driver 40*a*, a second backlight driver 50*a*, a backlight 60*a*, and a display 90*a*. Additionally, the display device 902 further includes a video input part 921 and a control signal input/output part 922. The first backlight driver 40*a*, the second backlight driver 50*a*, the backlight 60*a*, and the display 90*a* correspond to the function parts shown in FIGS. 1 and 5, i.e. the first backlight driver 40, the second backlight driver 50, the backlight 60, and the display 90.

The first backlight driver 40*a* drives a first backlight 202 (i.e. the green LED 202G) (see FIGS. 1 and 5) of the backlight 60*a* based on a G-drive value which the control signal input/output part 922 receives from the video output device 901. The second backlight driver 50*a* drives a second backlight (i.e. the blue LED 203B) (see FIGS. 1 and 5) of the backlight 60*a* based on a B-drive value which the control signal input/output part 922 receives from the video output device 901.

The display 90*a* displays a video signal which the video input part 921 receives from the video output device 901.

As described above, the display system of the present embodiment is a display system including a display device and a video output device. Herein, the display device includes an emission part including a first light source emitting a first light, a second light source emitting a second light having a longer wavelength than the first light, and a fluorescent substance which is excited by the first light and the second light so as to emit a third light, while the video output device includes a controller which produces a driver value of the first light source and a drive value of the second light source based on a luminance of the first light, a luminance of the second light, and a luminance of the third light as well as a first target luminance of the first light source, a second target luminance of the second light source, and a third target luminance of the fluorescent substance, thus controlling the two light sources based on the drive values of the first and second light sources.

Additionally, the video output device of the present embodiment includes a controller which produces a driver value of the first light source and a drive value of the second light source based on the luminance of the first light emitted by the first light source, the luminance of the second light, having a longer wavelength than the first light, emitted by the second light source, and the luminance of the third light emitted by the fluorescent substance which is excited by the first light and the second light as well as the first target luminance of the first light source, the second target luminance of the second light source, and the third target luminance of the fluorescent substance, thus controlling the two light sources based on the drive values of the first and second light sources.

Owing to the above configuration of the present embodiment, the video output device 901 configured to supply video signals to the display device 902 is designed to produce drive values for the backlight 60*a* and gains of video signals. According to the configuration of the present embodiment, the display device 902 is able to reduce a power for driving the backlight 60*a*, thus reducing an amount of heat generated by the backlight 60*a*. As a result, the present embodiment can significantly extend the luminance life to be longer than the luminance life of the comparative example.

In the above, the present invention is described by way of the foregoing example in which the backlight 60 (or 60*a*) is used for the display 1 (or 902); but this is not a restriction. For example, it is possible to use the backlight 60 (or 60*a*) as the light source of a projector, the light source of a laser television set, or the like. Additionally, the display device 1 (or 902) of the present embodiment can be applied to a mobile information terminal, a navigation system, an advertisement-display board, an electronic signboard (e.g. Digital Signage), or the like.

In this connection, it is possible to store programs, implementing the function of the controller 10 of FIG. 1 or the function of the controller 10*a* of FIG. 13 in the foregoing embodiment, in computer-readable storage media; thereafter, a computer system may read and execute programs stored in the storage media so as to implement the functions of the foregoing parts. Herein, the "computer system" may embrace the OS and the hardware such as peripheral devices.

Additionally, the "computer system" using the WWW system may embrace homepage-providing environments (or homepage-display environments).

The "computer-readable storage media" refer to flexible disks, magneto-optic disks, ROM (Read-Only Memory), portable media such as CD-ROM, USB memory connected via USB (Universal Serial Bus) I/F (Interface), and storage devices such as hard disks installed in computer systems. Additionally, the "computer-readable storage media" may embrace any measures configured to retain programs for a certain time such as volatile memory installed in computer systems serving as servers or clients. Moreover, the above programs may be produced to implement part of the foregoing functions, or the above programs may be combined with other programs pre-installed in computer systems so as to implement the foregoing functions.

REFERENCE SIGNS LIST

1 . . . display device; 10 . . . controller; 20 . . . storage unit; 30 . . . operation part; 40 . . . first backlight driver; 50 . . . second backlight driver; 60 . . . backlight; 70 . . . detection part; 80 . . . video signal adjustment part; 90 . . . display; 101 . . . target luminance calculation part; 111 . . . current luminance calculation part; 112 . . . current G-luminance value register; 113 . . . target G-luminance value register; 114 . . . current R-luminance value register; 115 . . . target R-luminance value register; 116 . . . current B-luminance value register; 117 . . . target B-luminance value register; 121 . . . G-luminance comparator; 122 . . . R-luminance comparator; 123 . . . B-luminance comparator; 124 . . . comparator; 131 . . . drive value limiter; 201 . . . substrate; 202G . . . green LED; 203B . . . blue LED; 204 . . . fluorescent substance; 900 . . . image display system; 901 . . . video output device; 902 . . . display device; 903 . . . video cable; 904 . . . control signal cable

The invention claimed is:

1. A display device comprising:

an emission part including a first light source emitting a first light, a second light source emitting a second light having a longer wavelength than the first light, and a fluorescent substance which is excited by the first light and the second light so as to emit a third light; and a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources, wherein the controller determines the drive value of the second light source such that the luminance of the second light matches the second target luminance, and wherein the controller further increases the drive value of the first light source such that the luminance of the first light matches the first target luminance when the luminance of the first light is smaller than the first target luminance at a time at which the controller determines the drive value of the first light source such that the luminance of the third light matches the third target luminance.

2. The display device according to claim 1, wherein the first light source and the second light source are attached to a same substrate.

3. The display device according to claim 1, wherein the controller controls the first light source and the second light source such that a power consumption or a temperature of the emission part falls within a rated value of the emission part.

4. The display device according to claim 1, wherein the first light is a blue light, the second light is a green light, and the third light is a red light.

5. The display device according to claim 1, further comprising:

a storage unit configured to store the first target luminance for the first light, the second target luminance for the second color light, and the third target luminance for the third color light; and a detector configured to detect the luminance of the first light currently emitted by the first light source, the luminance of the second light currently emitted by the second light source, and the luminance of the third light currently emitted by the fluorescent substance.

6. A display device comprising:

an emission part including a first light source emitting first light, a second light source emitting a second light having a longer wavelength than the first light, a fluorescent substance which is excited by the first light and the second light so as to emit a third light;

a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources;

a video signal adjustment part configured to control a video signal based on a gain of a video signal for each of RGB colors, wherein the controller generates a control signal used to adjust the gain of a video signal for each of RGB colors based on the luminance of the first light to the luminance of the third light and the first target luminance to the third target luminance, thus outputting the control signal to the video signal adjustment part, wherein the controller determines the drive value of the second light source such that the luminance of the second light match the second target luminance, wherein the controller generate the control signal to reduce the gain of a video signal corresponding to the luminance of the first light when the luminance of the first light is higher than the first target luminance, and wherein the controller generates the control signal to reduce the gain of a video signal corresponding to the luminance of the third light when the luminance of the third light is higher than the third target luminance.

7. A display system comprising a display device and a video output device, wherein the display device includes an emission part further including a first light source emitting a first light, a second light source emitting a second light having a longer wavelength than the first light, and a fluorescent substance which is excited by the first light and the second light so as to emit a third light, wherein the video output device includes a controller configured to generate a drive value of the first light source and a drive value of the second light source based on a luminance of the first light, a luminance of the second light, a luminance of the third light, a first target luminance for the first light source, a second target luminance for the second light source, and a third target luminance for the fluorescent substance, thus controlling two light sources based on the drive values of the first and second light sources, wherein the controller determines the drive value of the second light source such that the luminance of the second light matches the second target luminance, and wherein the controller further increases the drive value of the first light source such that the luminance of the first light matches the first target luminance when the luminance of the first light is smaller than the first target luminance at a time at which the controller determines the drive value of the first light source such that the luminance of the third light matches the third target luminance.

8. A video output device comprising a controller configured to generate a drive value of a first light source and a drive value of a second light source based on a luminance of a first light emitted by the first light source, a luminance of a second light, having a longer wavelength than the first light, emitted by the second light source, a luminance of a third light emitted by a fluorescent substance being excited by the first light and the second light, a first target luminance for the first light source, a second target luminance for the second light source, and a third target luminance for the fluorescent substance, thus controlling two light sources based on the drive values of the first and second light sources, wherein the controller determines the drive value of the second light source such that the luminance of the second light matches the second target luminance, and wherein the controller further increases the drive value of the first light source such that the luminance of the first light matches the first target luminance when the luminance of the first light is smaller than the first target luminance at a time at which the controller determines the drive value of the first light source such that the luminance of the third light matches the third target luminance.

9. A control method of a display device comprising:

generating a drive value of a first light source and a drive value of a second light source based on a luminance of a first light emitted by the first light source, a luminance of a second light, having a longer wavelength than the first light, emitted by the second light source, a luminance of a third light emitted by a fluorescent substance being excited by the first light and the second light, a first target luminance for the first light source, a second target luminance for the second light source, and a third target luminance for the fluorescent substance; and controlling two light sources based on the drive values of the first and second light sources;

wherein the drive value of the second light source is determined such that the luminance of the second light matches the second target luminance, and wherein the drive value of the first light source is increased such that the luminance of the first light matches the first target luminance when the luminance of the first light is smaller than the first target luminance at a time of determining the drive value of the first light source such that the luminance of the third light matches the third target luminance.

* * * * *